US011702609B1

(12) United States Patent
Duan et al.

(10) Patent No.: US 11,702,609 B1
(45) Date of Patent: Jul. 18, 2023

(54) METHOD FOR IMPROVING LUBRICATING PERFORMANCE OF LUBRICATING OILS

(71) Applicant: WUHAN RESEARCH INSTITUTE OF MATERIALS PROTECTION, Wuhan (CN)

(72) Inventors: Haitao Duan, Wuhan (CN); Linlin Duan, Wuhan (CN); Dan Jia, Wuhan (CN); Shengpeng Zhan, Wuhan (CN); Tian Yang, Wuhan (CN); Jiesong Tu, Wuhan (CN)

(73) Assignee: WUHAN RESEARCH INSTITUTE OF MATERIALS PROTECTION, Wuhan (CN)

( * ) Notice: Subject to any disclaimer, the term of this patent is extended or adjusted under 35 U.S.C. 154(b) by 0 days.

(21) Appl. No.: 17/844,718

(22) Filed: Jun. 21, 2022

(30) Foreign Application Priority Data

May 25, 2022 (CN) ..... 202210587306.6

(51) Int. Cl.
*C10M 125/22* (2006.01)
*C10M 107/02* (2006.01)
(Continued)

(52) U.S. Cl.
CPC ..... *C10M 125/22* (2013.01); *C10M 107/02* (2013.01); *C10M 169/04* (2013.01);
(Continued)

(58) Field of Classification Search
CPC ..... C10M 125/22; C10M 107/02; C10M 169/04; C10M 177/00; C10M 2201/085;
(Continued)

(56) References Cited

U.S. PATENT DOCUMENTS 4,648,985 A * 3/1987 Thorsell ..... C10M 137/06 508/435
4,867,890 A * 9/1989 Colclough ..... C10M 167/00 508/378

(Continued)

OTHER PUBLICATIONS

CNIPA, Notification to grant patent right for invention in CN202210587306.6, dated Nov. 30, 2022.
Wuhan Research Institute of Materials Protection (Applicant), Original claims (allowed, as filed) for invention in CN202210587306.6, May 25, 2022.

*Primary Examiner* — Ellen M McAvoy
(74) *Attorney, Agent, or Firm* — Zhigang Ma

(57) ABSTRACT

A method for improving lubricating performance of lubricating oils is provided and includes: adding copper phosphate with a porous structure into a base oil, a mass percent of the copper phosphate with the porous structure to the base oil is 0.0001% ~50%, the porous structure is one of a foam porous structure and a porous nanoflower structure. The copper phosphate with the porous structure is obtained by adding a divalent copper salt solution into an alkaline disodium hydrogen phosphate solution or alkaline phosphoric acid buffer solution and then separating a precipitate. When a ratio of a concentration of a divalent copper ion to that of a phosphate ion is 1:0.1 to 400, the porous structure is porous foam or nanoflower. The porous structure can be well dispersed in the lubricating oil for 1 hour. After adding the lubricating oil, excellent friction reduction and anti-wear is achieved.

9 Claims, 4 Drawing Sheets

(51) Int. Cl.

| | |
|---|---|
| ***C10M 169/04*** | (2006.01) |
| ***C10M 177/00*** | (2006.01) |
| *C10N 70/00* | (2006.01) |
| *C10N 20/06* | (2006.01) |

(52) U.S. Cl.
CPC .... *C10M 177/00* (2013.01); *C10M 2201/085* (2013.01); *C10M 2205/0206* (2013.01); *C10N 2020/06* (2013.01); *C10N 2070/00* (2013.01)

(58) Field of Classification Search
CPC ..... C10M 2205/0206; C10N 2020/06; C10N 2070/00
See application file for complete search history.

(56) References Cited

U.S. PATENT DOCUMENTS 5,397,485 A * 3/1995 Weichsel ..... C10M 171/06 508/150
5,589,443 A * 12/1996 Denton ..... C10M 125/22 175/227
6,774,091 B2 * 8/2004 Dituro ..... C10M 169/044 508/591
7,897,548 B2 * 3/2011 Lam ..... C10M 163/00 508/391
8,361,940 B2 * 1/2013 Nakazato ..... C10M 169/045 508/156
8,546,311 B2 * 10/2013 Fahl ..... C10M 141/10 508/188

* cited by examiner

METHOD FOR IMPROVING LUBRICATING PERFORMANCE OF LUBRICATING OILS

TECHNICAL FIELD

The disclosure belongs to the field of lubricating oil technologies, and relates to a lubricating oil additive, in particular, to a method for improving the lubricating performance of lubricating oils.

DESCRIPTION OF RELATED ART

Friction requires energy to overcome. At present, the energy in industries, transportation and other fields mainly comes from fossil fuels, which produce a considerable part of greenhouse gas to exhaust. Globally, friction and wear have lost more than 50% of the world's energy, which is also one of the main reasons for the scrapping of materials and equipment. Therefore, it is of great significance to control friction and reduce wear in modern technology. So far, one of effective methods in this industry is to use a lubricating oil for lubrication.

In recent years, it has been found that nanomaterials have great advantages in tribology. As lubricant additives, the nanomaterials can significantly reduce the friction coefficient and play an important role in reducing wear. In recent ten years, researchers pay more and more attention to the exploration of the nanomaterials as lubricating oil additives. However, at present, most preparation processes of the nanomaterials are complex, high cost, and not easy to realize industrialized production. To realize the industrial application of nanomaterials, it is necessary to develop a nanomaterial additive with a simple and reliable preparation process, which is economical and easily operated.

SUMMARY OF THE DISCLOSURE

The purpose of the disclosure is to propose a method for improving the lubricating performance of lubricating oils, and thereby solve the above problem. By adding copper phosphate with a porous structure as a lubricating oil additive into a base oil, a friction coefficient is significantly reduced and the wear of friction pair surfaces is reduced. The disclosure adds a divalent copper salt solution to a disodium hydrogen phosphate solution, and separates a precipitate to obtain the copper phosphate with the porous structure. When a ratio of a concentration of a divalent copper ion to that of a phosphate ion is 1:0.1 to 400, a microstructure of the copper phosphate is porous foams or nanoflowers. The copper phosphate does not contain crystal water or contains 1 to 3 numbers of crystal water. The specific content of the crystal water is determined by a washing solution and a drying method. The prepared lubricating oil additive has a large specific surface area and strong adsorption capacity. The porous structure can be well dispersed in the lubricating oil and can be kept well dispersed for 1 hour. After adding into the lubricating oil, the significant improvement of friction reduction and anti-wear is achieved. Compared with the pure lubricating oil, the friction coefficient and wear rate are reduced by more than 70% and 99%, respectively.

In order to achieve the above purpose, the technical schemes adopted by the disclosure are as follows.

A method for improving the lubricating performance of lubricating oils, including: adding copper phosphate with a porous structure into a base oil, a mass percent of the copper phosphate with the porous structure to the base oil is in a range of 0.0001% to 50%, and the porous structure is one of a foam porous structure and a porous nanoflower structure.

In an embodiment, the base oil is one of a mineral oil, a semi-synthetic oil, a synthetic oil, and a vegetable oil.

In an embodiment, the copper phosphate does not contain crystal water; or the copper phosphate contains 1 to 3 numbers of crystal water.

In an embodiment, a preparation method of the copper phosphate with the porous structure includes:

adding a divalent copper salt solution into an alkaline phosphoric acid solution for reaction, and after the reaction, separating a precipitate to obtain the copper phosphate with the porous structure; the alkaline phosphoric acid solution being one of a disodium hydrogen phosphate solution and an alkaline phosphoric acid buffer solution.

In an embodiment, the divalent copper salt solution is one of a copper sulfate solution, a copper chloride solution, and a copper nitrate solution.

In an embodiment, the alkaline phosphoric acid buffer solution is obtained by mixing sodium dihydrogen phosphate with dibasic sodium phosphate.

In an embodiment, a ratio of a concentration of a divalent copper ion in the divalent copper salt solution to that of a phosphate ion in the alkaline phosphoric acid solution is 1:0.1 to 400.

In an embodiment, the precipitate is separated by using a decantation method, a gravity sedimentation method, a filtration method, and a centrifugation method.

In an embodiment, the potential of hydrogen (PH) of the alkaline phosphoric acid solution is in a range of 7 to 12.

The porous structure of the copper phosphate involved in the technical schemes is essentially different from sulfur phosphoric acid series or dialkyl dithiophosphate (DDP), aerofloat (such as CuDDP or ZnDDP) commonly used as lubricating oil additives. The above commonly used lubricating oil additives are oil-soluble high molecular substances or liquid, which can be directly soluble in the oil. An action mechanism is that the above commonly used lubricating oil additive has a chemical reaction in a friction process, an oil film at the friction interface is formed to promote lubrication; or long molecular chains entangle with oil molecules to increase a thickness of the oil film. The copper phosphate of the disclosure has a molecular formula $Cu_3(PO_4)_2 \cdot XH_2O$, X is 0 to 3, and its form is solid. The copper phosphate of the disclosure belongs to a kind of crystalline material and lamellar nanomaterial, with a large specific surface area, the strong adsorption, and better dispersion in the oil than agglomerates. An action mechanism is that the porous structure of the copper phosphate enters the friction interface to avoid the direct contact between friction pairs and transform the friction between steel and steel into a friction between the steel and nanoflakes in the porous structure of the copper phosphate, which significantly decreases the friction coefficient and reduces wear marks. The mechanism diagrams of a foam porous structure of the copper phosphate and nanoflowers of the copper phosphate are shown in FIG. 6 and FIG. 7, respectively.

The disclosure has the following technical advantages compared with the prior art:

(1) the method is simple and easy; the experimental process is mild and simple, does not need special equipment, high temperature, and other drastic experimental methods, and does not involve any organic reagent, which is in line with the green environmental protection route;

(2) the sources of the raw materials are wide and economical, and the raw materials can be widely used as lubricating oil additives;

(3) the significant improvement of friction reduction and anti-wear is achieved, the friction coefficient and wear rate are reduced by more than 70% and 99%, respectively.

DETAILED DESCRIPTION OF EMBODIMENTS

In order to better understand the above purposes, features and advantages of the disclosure, the disclosure will be further described in detail below in combination with the accompanying drawings and specific embodiments. It should be noted that the embodiments of the disclosure and the features in the embodiments can be combined with each other without conflict.

Many specific details are set forth in the following description to facilitate a full understanding of the disclosure. However, the disclosure can also be implemented in other ways different from those described here. Therefore, the scope of protection of the disclosure is not limited by the specific embodiments disclosed below.

Embodiment 1

A method for improving lubricating performance of a lubricating oil. Copper phosphate with a porous structure is added to a base oil, and the components by the mass percent include: 0.55 g of the copper phosphate with the porous structure, and 5 g of the PAO4 base oil.

(1) Preparation of the Copper Phosphate with the Porous Structure (i.e., Foam Porous Structure)

After 1 mL of 0.2 mol/L copper sulfate solution is mixed with 400 mL of 0.2 mol/L disodium hydrogen phosphate, a precipitate is obtained by centrifugation, the precipitate is the copper phosphate with the foam porous structure. After the copper phosphate with the foam porous structure is dried in an oven at 65° C., 0.55 g of the dried copper phosphate with the foam porous structure is weighed and added to 5 g of the PAO4 base oil.

Figure 1:
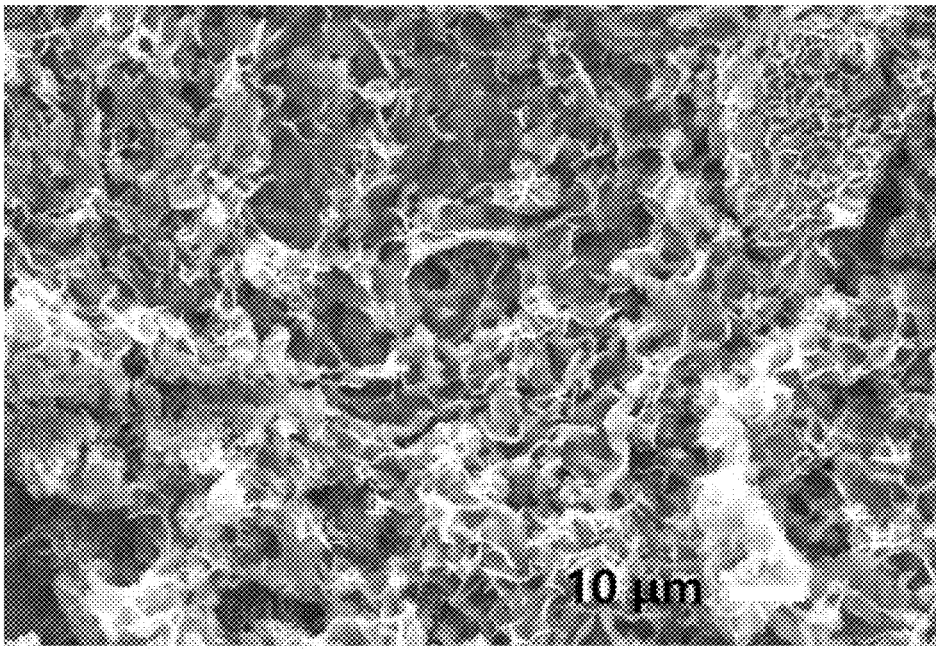
FIG. 1 illustrates a scanning electron microscope (SEM) picture of copper phosphate with a porous structure (i.e., foam porous structure) according to an embodiment 1.

The SEM picture of the copper phosphate with the foam porous structure is shown in FIG. 1.

(2) Determination Testing of Friction-Reduction and Antiwear Properties

Performing a ball disk reciprocating friction test on a friction and wear tester provided by Rtec: a GCr15 steel ball with a diameter of 6.3 mm and a TA5 titanium alloy disk with a diameter of 4*4 cm are subject to reciprocating friction.

Test conditions: a load is 10 N, and a speed is 8 Hz (a linear speed is 128 mm/s).

(3) Comparative Analysis of Results of Friction-Reduction and Antiwear Properties Compared with the pure PAO4 (without any additives), the friction coefficient is reduced by 73%, and the wear rate is reduced by 99%.

Embodiment 2

A method for improving lubricating performance of a lubricating oil. Copper phosphate with a porous structure is added to a base oil, and the components by the mass percent include: 0.55 g of the copper phosphate with the porous structure, and 5 g of the PAO4 base oil.

(1) Preparation of the Copper Phosphate with the Porous Structure (i.e., Nanoflower Structure)

After 1 mL of 0.2 mol/L copper sulfate solution is mixed with 100 mL of 0.2 mol/L disodium hydrogen phosphate, a precipitate is obtained by centrifugation, the precipitate is the copper phosphate with the nanoflower structure. After the copper phosphate with the nanoflower structure is dried in an oven at 65° C., 0.55 g of the dried copper phosphate with the nanoflower structure is weighed and added to 5 g of the PAO4 base oil, and ultrasonic dispersion for 30 min.

Figure 2:
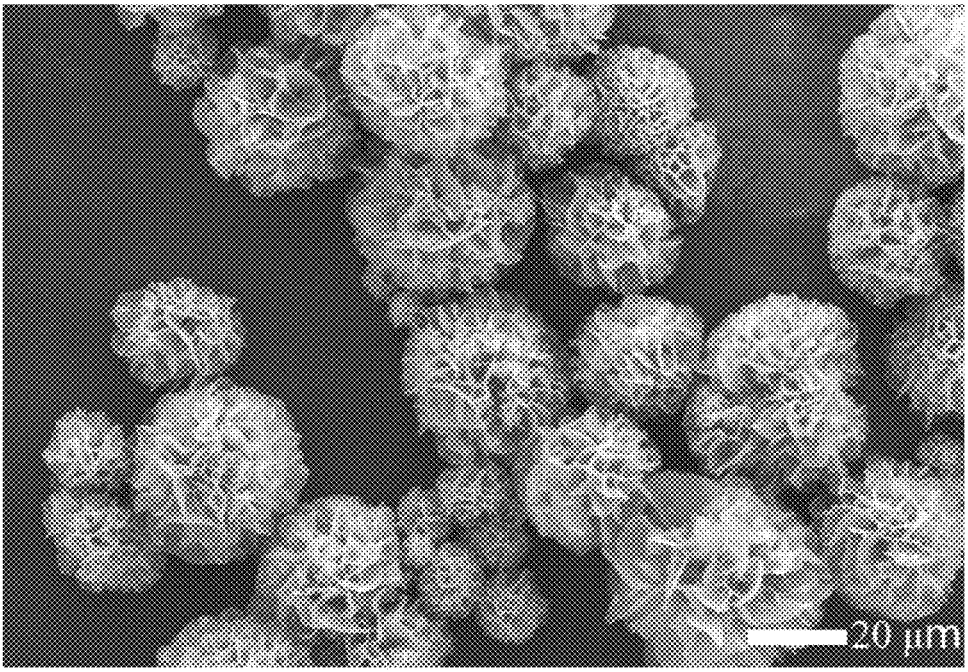
FIG. 2 illustrates a SEM picture of copper phosphate with a porous structure (i.e., nanoflower structure) according to an embodiment 2.

The SEM picture of the copper phosphate with the nanoflower structure is shown in FIG. 2.

(2) Determination Testing of Friction-Reduction and Antiwear Properties

Performing a ball disk reciprocating friction test on a friction and wear tester provided by Rtec: a GCr15 steel ball with a diameter of 6.3 mm and a TA5 titanium alloy disk with a diameter of 4*4 cm are subject to reciprocating friction.

Test conditions: a load is 10 N, and a speed is 8 Hz (a linear speed is 128 mm/s).

(3) Comparative Analysis of Results of Friction-Reduction and Antiwear Properties Compared with the pure PAO4, the friction coefficient is reduced by 74%, and the wear rate is reduced by 99%.

Figure 3:
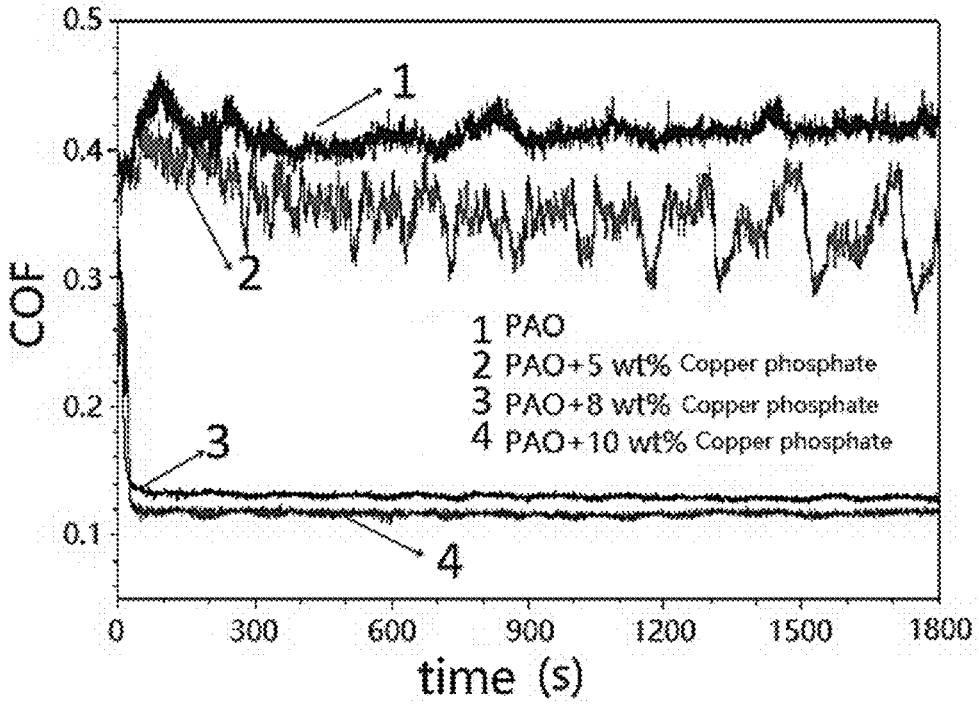
FIG. 3 illustrates a schematic diagram of friction coefficients of copper phosphate with a porous structure (i.e., nanoflower structure) with different mass fractions as lubricating oil additives.
Figure 4:
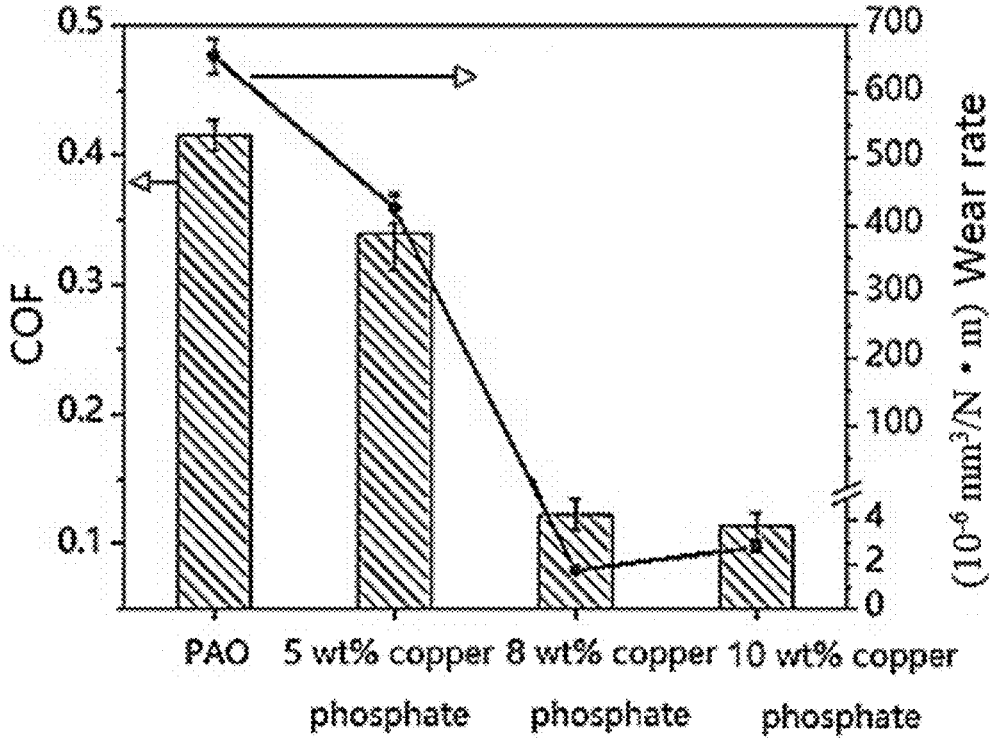
FIG. 4 illustrates a schematic diagram of comparisons of friction coefficients and wear rates of copper phosphate with a porous structure (i.e., nanoflower structure) with different mass fractions as lubricating oil additives.
Figure 5A:
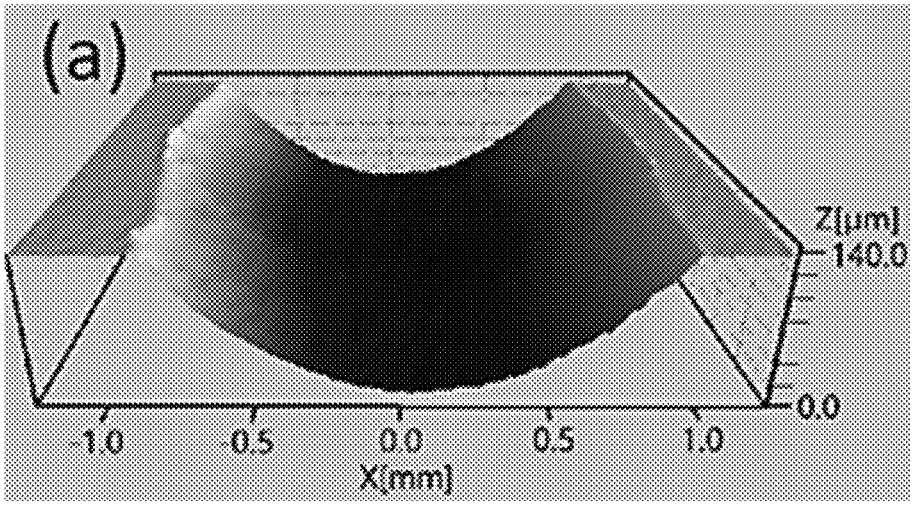
FIG. 5A illustrates a 3D white light picture of a wear mark of pure poly-alpha-olefin 4 (PAO4) lubricating oil.
Figure 5B:
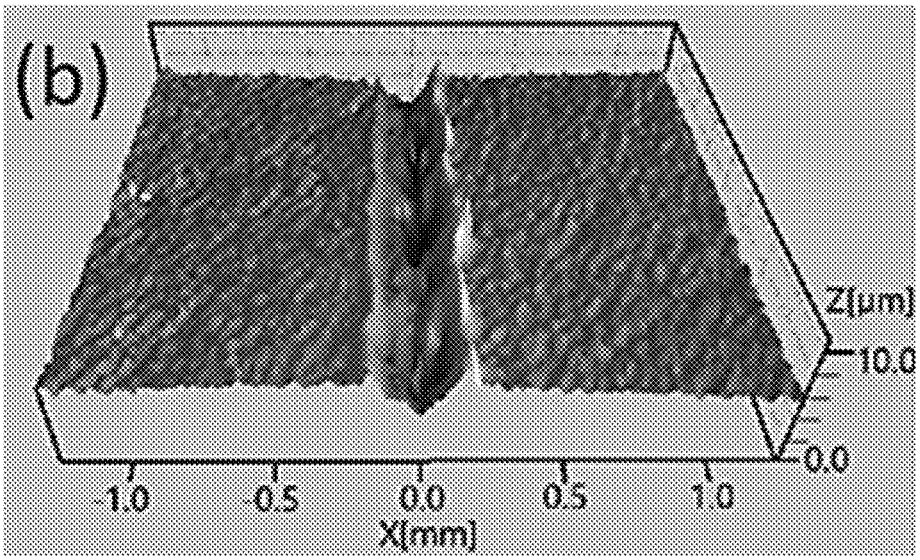
FIG. 5B illustrates a 3D white light picture of a wear mark of PAO4 lubricating oil added with the copper phosphate with a porous structure (i.e., nanoflower structure) of the embodiment 2.
Figure 6:
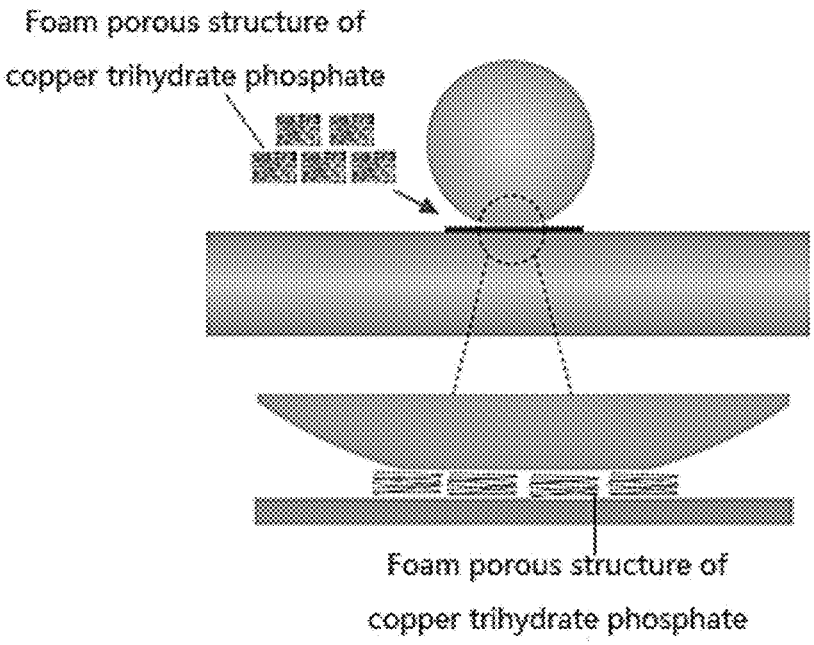
FIG. 6 illustrates a schematic diagram of a lubrication mechanism of a foam porous structure of copper phosphate.
Figure 7:
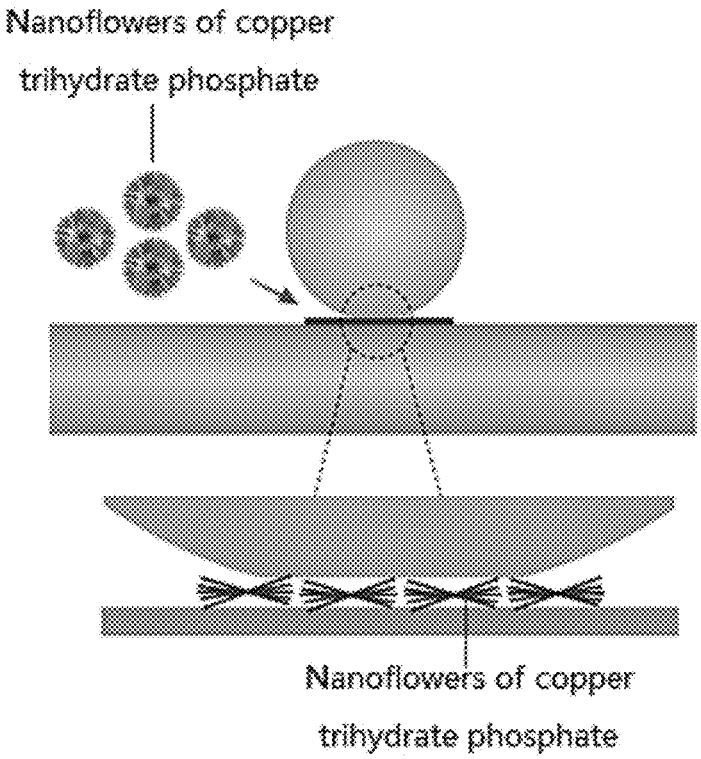
FIG. 7 illustrates a schematic diagram of a lubrication mechanism of nanoflowers of copper phosphate.

The friction coefficient is shown in FIG. 3, a comparison between the friction coefficient and the wear rate is shown in FIG. 4, a 3D white light picture of a wear mark of the pure PAO4 is shown in FIG. 5A, and a 3D white light picture of a wear mark of the PAO4 lubricating oil added with the copper phosphate with the nanoflower structure is shown in FIG. 5B.

Embodiment 3

A method for improving lubricating performance of a lubricating oil. Copper phosphate with a porous structure is added to a base oil, and the components by the mass percent include: 0.55 g of the copper phosphate with the porous structure, and 5 g of the PAO4 base oil.

(1) Preparation of the Copper Phosphate with the Porous Structure (i.e., Foam Porous Structure)

After 1 mL of 0.2 mol/L copper sulfate solution is mixed with 400 mL of 0.2 mol/L disodium hydrogen phosphate, a precipitate is obtained by centrifugation, the precipitate is the copper phosphate with the foam porous structure. Petroleum ether is used to clean the precipitate several times without drying, and then the precipitate and the petroleum are directly mixed with the PAO4. An oil sample containing the copper phosphate with the porous structure was prepared by string at 90° C. for 2 hours to volatilize the petroleum ether. The mass percent of the copper phosphate with the porous structure is calculated according to an initial weight of the oil sample and a weight after heating treatment. A certain mass of the PAO can also be added to adjust the mass percent.

(2) Determination Testing of Friction-Reduction and Antiwear Properties

Performing a ball disk reciprocating friction test on a friction and wear tester provided by Rtec: a GCr15 steel ball with a diameter of 6.3 mm and a TA5 titanium alloy disk with a diameter of 4*4 cm are subject to reciprocating friction.

Test conditions: a load is 10 N, and a speed is 8 Hz (a linear speed is 128 mm/s).

(3) Comparative Analysis of Results of Friction-Reduction and Antiwear Properties Compared with the pure PAO4, the friction coefficient is reduced by 75%, and the wear rate is reduced by 99%.

Embodiment 4

A method for improving lubricating performance of a lubricating oil. Copper phosphate with a porous structure is added to a base oil, and the components by the mass percent include: 0.55 g of the copper phosphate with the porous structure, and 5 g of the PAO4 base oil.

(1) Preparation of the Copper Phosphate with the Porous Structure

After 1 mL of 0.2 mol/L copper sulfate solution is mixed with 200 mL of 0.2 mol/L disodium hydrogen phosphate, a precipitate is obtained by centrifugation, the precipitate is the copper phosphate with the porous structure (i.e., foam porous structure and nanoflower structure). After the copper phosphate with the porous structure is dried in an oven at 65° C., 0.55 g of the dried copper phosphate with the porous structure is weighed and added to 5 g of the PAO4 base oil.

(2) Determination Testing of Friction-Reduction and Antiwear Properties

Performing a ball disk reciprocating friction test on a friction and wear tester provided by Rtec: a GCr15 steel ball with a diameter of 6.3 mm and a TA5 titanium alloy disk with a diameter of 4*4 cm are subject to reciprocating friction.

Test conditions: a load is 10 N, and a speed is 2 Hz (a linear speed is 36 mm/s).

(3) Comparative Analysis of Results of Friction-Reduction and Antiwear Properties Compared with the pure PAO4, the friction coefficient is reduced by 45%, and the wear rate is reduced by 81%.

Embodiment 5

A method for improving lubricating performance of a lubricating oil. Copper phosphate with a porous structure is added to a base oil, and the components by the mass percent include: 0.1 g of the copper phosphate with the porous structure, and 5 g of the PAO4 base oil.

(1) Preparation of the Copper Phosphate with the Porous Structure

After 1 mL of 0.2 mol/L copper sulfate solution is mixed with 200 mL of 0.2 mol/L disodium hydrogen phosphate, a precipitate is obtained by centrifugation, the precipitate is the copper phosphate with the porous structure. After suction filtration and separation, washing the copper phosphate with the porous structure with ethanol for several times, then drying the copper phosphate with the porous structure in an oven at 65° C., weighing the dried copper phosphate with the porous structure of 0.1 g, and adding it to the PAO4 base oil of 5 g.

(2) Determination Testing of Friction-Reduction and Antiwear Properties

Performing a ball disk reciprocating friction test on a friction and wear tester provided by Rtec: a GCr15 steel ball with a diameter of 6.3 mm and a TA5 titanium alloy disk with a diameter of 4*4 cm are subject to reciprocating friction.

Test conditions: a load is 10 N, and a speed is 8 Hz (a linear speed is 36 mm/s).

(3) Comparative Analysis of Results of Friction-Reduction and Antiwear Properties Compared with the pure PAO4, the friction coefficient is reduced by 35%, and the wear rate is reduced by 58%.

Embodiment 6

A method for improving lubricating performance of a lubricating oil. Copper phosphate with a porous structure is added to a base oil, and the components by the mass percent include: 0.55 g of the copper phosphate with the porous structure, and 5 g of the PAO4 base oil.

(1) Preparation of the Copper Phosphate with the Porous Structure (i.e., Nanoflower Structure)

56 mL of 0.2 mol/L sodium dihydrogen phosphate is mixed with 144 mL of 0.2 mol/L dibasic sodium phosphate to obtain 200 mL of 0.2 mol/L phosphate buffer solution with PH being 7.2.

After 50 mL of 0.2 mol/L copper sulfate solution is mixed with 200 mL phosphate buffer solution, a precipitate is obtained by centrifugation, the precipitate is the copper phosphate with the foam porous structure. After the copper phosphate with the foam porous structure is dried in an oven at 65° C., 0.55 g of the dried copper phosphate with the foam porous structure is weighed and added to 5 g of the PAO4 base oil.

(2) Determination Testing of Friction-Reduction and Antiwear Properties

Performing a ball disk reciprocating friction test on a friction and wear tester provided by Rtec: a GCr15 steel ball with a diameter of 6.3 mm and a TA5 titanium alloy disk with a diameter of 4*4 cm are subject to reciprocating friction.

Test conditions: a load is 10 N, and a speed is 8 Hz (a linear speed is 128 mm/s).

(3) Comparative Analysis of Results of Friction-Reduction and Antiwear Properties Compared with the pure PAO4 (without any additives), the friction coefficient is reduced by 70%, and the wear rate is reduced by 99%.

The disclosure provides the method for improving the lubricating performance of the lubricating oil. The divalent copper salt solution is added to the disodium hydrogen phosphate solution or the alkaline phosphoric acid buffer solution, and the precipitate is separated to obtain the copper phosphate. When the ratio of the concentration of the divalent copper ion to the concentration of the phosphate ion is 1:0.1 to 400, the microstructure of the copper phosphate is porous foam or nanoflowers. Due to the large specific surface area and strong adsorption, the porous structure can be well dispersed in the lubricating oil. After adding the lubricating oil, excellent friction reduction and anti-wear effect is achieved. Compared with the pure lubricating oil, the friction coefficient is reduced by more than 75% and the wear rate is reduced by more than 99%. The experimental method is simple and easy, with a wide range of raw materials. The experimental process is mild and simple, does not need intense experimental methods such as high temperature, and does not involve any organic reagents. The device for the disclosure is simple, conforms to the green environmental protection route, and can be widely applied to lubricating oil additives.

The above is only illustrated embodiments of the disclosure and are not intended to limit the disclosure. For those skilled in the art, the disclosure may have various changes and variations. Any amendment, equivalent replacement, improvement, etc. made within the spirit and principles of the disclosure shall be included in the protection scope of the disclosure.

What is claimed is:

1. A method for improving lubricating performance of lubricating oils, comprising:

adding a divalent copper salt solution into an alkaline phosphoric acid solution for reaction, and after the reaction, separating a precipitate to obtain copper phosphate with a porous structure; wherein a ratio of a concentration of a divalent copper ion in the divalent copper salt solution to that of a phosphate ion in the alkaline phosphoric acid solution is 1:0.1 to 400; and adding the copper phosphate with the porous structure into a base oil, wherein a mass percent of the copper phosphate with the porous structure to the base oil is in a range of 0.0001% to 50%, and the porous structure is one of a foam porous structure and a porous nanoflower structure.

2. The method for improving the lubricating performance of lubricating oils according to claim 1, wherein the base oil is one of a mineral oil, a semi synthetic oil, a synthetic oil, and a vegetable oil.

3. The method for improving the lubricating performance of lubricating oils according to claim 1, wherein the copper phosphate does not contain crystal water; or the copper phosphate contains 1 to 3 number of crystal water.

4. The method for improving the lubricating performance of lubricating oils according to claim 1, wherein the alkaline phosphoric acid solution is one of a disodium hydrogen phosphate solution and an alkaline phosphoric acid buffer solution.

5. The method for improving the lubricating performance of lubricating oils according to claim 4, wherein the divalent copper salt solution is one of a copper sulfate solution, a copper chloride solution, and a copper nitrate solution.

6. The method for improving the lubricating performance of lubricating oils according to claim 4, wherein the alkaline phosphoric acid buffer solution is obtained by mixing sodium dihydrogen phosphate with dibasic sodium phosphate.

7. The method for improving the lubricating performance of lubricating oils according to claim 4, wherein the precipitate is separated by using one of a decantation method, a gravity sedimentation method, a filtration method, and a centrifugation method.

8. The method for improving lubricating performance of lubricating oils according to claim 4, wherein the potential of hydrogen (PH) of the alkaline phosphoric acid solution is in a range of 7 to 12.

9. The method for improving lubricating performance of lubricating oils according to claim 1, wherein the copper phosphate with the porous structure has a molecular formula as follows: $Cu_3(PO_4)_2 \cdot XH_2O$, where X is 0 to 3; and a form of the copper phosphate with the porous structure is solid.

* * * * *